US010096930B2

(12) United States Patent
Kondo et al.

(10) Patent No.: US 10,096,930 B2
(45) Date of Patent: Oct. 9, 2018

(54) CONNECTOR

(71) Applicant: HOSIDEN CORPORATION, Osaka (JP)

(72) Inventors: Hayato Kondo, Osaka (JP); Masakazu Yamazaki, Osaka (JP)

(73) Assignee: HOSIDEN CORPORATION, Osaka (JP)

( * ) Notice: Subject to any disclaimer, the term of this patent is extended or adjusted under 35 U.S.C. 154(b) by 0 days.

(21) Appl. No.: 15/433,291

(22) Filed: Feb. 15, 2017

(65) Prior Publication Data

US 2017/0244193 A1 Aug. 24, 2017

(30) Foreign Application Priority Data

Feb. 24, 2016 (JP) ..... 2016-033442
Mar. 25, 2016 (JP) ..... 2016-061759

(51) Int. Cl.

*H01R 13/648* (2006.01)
*H01R 13/506* (2006.01)
*H01R 13/504* (2006.01)
*H01R 13/512* (2006.01)
*H01R 13/658* (2011.01)

(Continued)

(52) U.S. Cl.

CPC ..... *H01R 13/506* (2013.01); *H01R 13/504* (2013.01); *H01R 13/512* (2013.01);

(Continued)

(58) Field of Classification Search

CPC .. H01R 13/506; H01R 13/504; H01R 13/512; H01R 13/648

(Continued)

(56) References Cited

U.S. PATENT DOCUMENTS 4,191,443 A * 3/1980 Doyle ..... H01R 13/506 439/462
4,720,155 A * 1/1988 Schildkraut ..... H05K 9/0007 439/108

(Continued)

FOREIGN PATENT DOCUMENTS

EP 2284961 2/2011
EP 2884598 A1 6/2015

(Continued)

OTHER PUBLICATIONS

Search Report issued in EPO Patent Application No. 17157636.6, dated Sep. 25, 2017.

*Primary Examiner* — Abdullah Riyami
*Assistant Examiner* — Nader Alhawamdeh
(74) *Attorney, Agent, or Firm* — Greenblum & Bernstein, P.L.C.

(57) ABSTRACT

A connector includes a shell that has a cylindrical shape and includes a body portion and a leg portion, the body portion being connected to a shell of the other connector, a ground plate that is a conductor plate, a claw that has a structure in which part of the ground plate is raised in a connector connection direction so as to have a strip-shaped tip and the tip supports the leg portion of the shell, and a case made of an insulator, the case to which the shell and the ground plate are to be attached. The case includes a plate-like base portion, a slit that is provided in one surface of the base portion, the slit into which the leg portion is to be inserted, and a groove that is provided in the other surface of the base portion, the groove into which the claw is to be inserted.

6 Claims, 13 Drawing Sheets

(51) Int. Cl.
*H01R 13/502* (2006.01)
*H01R 13/52* (2006.01)
*H01R 13/66* (2006.01)

(52) U.S. Cl.
CPC ..... *H01R 13/648* (2013.01); *H01R 13/658* (2013.01); *H01R 13/502* (2013.01); *H01R 13/521* (2013.01); *H01R 13/6658* (2013.01)

(58) Field of Classification Search
USPC ..... 439/607.01; 361/799; 348/148
See application file for complete search history.

(56) References Cited

U.S. PATENT DOCUMENTS 5,288,248 A * 2/1994 Chen ..... H01R 13/658 439/607.19
5,304,069 A * 4/1994 Brunker ..... H01R 23/688 439/108
6,339,200 B1 * 1/2002 Shi ..... H01H 25/00 200/292
8,422,247 B2 * 4/2013 Kameyama ..... H01R 13/506 361/799
9,306,312 B2 * 4/2016 Dang ..... H01R 13/6586
9,674,410 B2 * 6/2017 Uchiyama ..... H04N 5/2252
2003/0224656 A1 * 12/2003 Yoshida ..... H01R 9/0518 439/578
2011/0096524 A1 4/2011 Kameyama
2015/0029337 A1 * 1/2015 Uchiyama ..... H04N 5/2252 348/148

FOREIGN PATENT DOCUMENTS

EP 2884598 B1 9/2016
JP 2009-283280 12/2009

* cited by examiner

CONNECTOR

TECHNICAL FIELD

The present invention relates to a connector which is made to be waterproof.

BACKGROUND ART

As an electronic device module which is made to be waterproof, there is an electronic device module described in, for example, Japanese Patent Application Laid Open No. 2009-283280 (hereinafter referred to as "Patent Literature 1"). The electronic device module described in Patent Literature 1 includes a ground shell 10. The ground shell 10 has a configuration including a flat plate portion 83, a contact piece 84 raised from the outer edge of the flat plate portion 83 toward the inside of a device, and a cylindrical contact body 85 provided in the center of the flat plate portion 83 in such a way as to protrude therefrom.

The electronic device module described in Patent Literature 1 achieves both a waterproofing property and a strong ground connection by being provided with the above-described ground shell 10 having the shape of a hat (the flat plate portion 83 is considered as the brim of the hat and the contact body 85 is considered as the crown of the hat).

Since the ground shell 10 disclosed in Patent Literature 1 has a complicated shape, although the ground shell 10 is generally produced by die casting, formation by a lathe (so-called turning), or the like, the presence of such a part which requires special working may result in an increase in the cost of a connector.

SUMMARY OF THE INVENTION

An object of the present invention is accordingly to provide a connector that achieves good shielding characteristics by using inexpensive parts formed by press working.

A connector of the present invention includes a shell, a ground plate, and a claw. The shell has a cylindrical shape and includes a body portion and a leg portion, and the body portion is connected to a shell of the other connector. The ground plate is a conductor plate. The claw has a structure in which part of the ground plate is raised in a connector connection direction so as to have a strip-shaped tip and the tip supports the leg portion of the shell.

Effects of the Invention

With a connector of the present invention, it is possible to achieve good shielding characteristics by using inexpensive parts formed by press working.

DETAILED DESCRIPTION OF THE EMBODIMENTS

Figure 1:
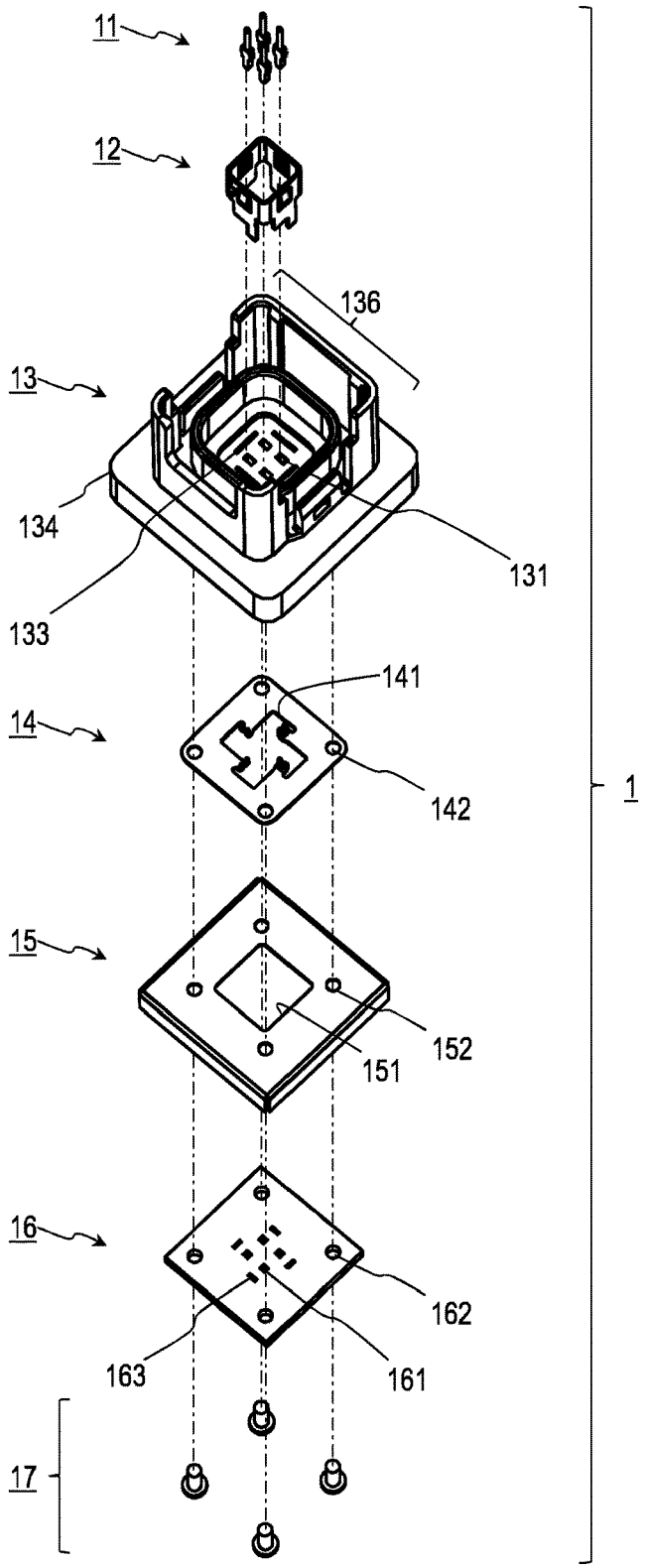
FIG. 1 is an exploded perspective view of a connector of a first embodiment.

Hereinafter, embodiments of the present invention will be described in detail. Incidentally, component portions having the same function will be identified with the same reference numeral and overlapping explanations thereof will be omitted.

First Embodiment

Hereinafter, with reference to FIG. 1, a connector of a first embodiment will be described. FIG. 1 is an exploded perspective view of a connector 1 of the present embodiment. As depicted in FIG. 1, the connector 1 of the present embodiment has a configuration including signal terminals 11 (four in total), each being formed of a conductor material and shaped like an arrowhead (a wedge), a shell 12 which is formed of a conductor material and shaped like a substantially rectangular cylinder, a case 13 including a plate-like base portion 134 and a fit portion 136 having the function of providing a fit with the other connector by protruding from the base portion 134, a ground plate 14 which is a quadrangular conductor plate, a shield case 15 which is formed of a conductor material and is quadrangular, a substrate 16 which is a quadrangular plate, and screws 17.

To one surface (a surface on which the fit portion 136 is formed; also referred to as a front surface) of the base portion 134, the signal terminals 11 and the shell 12 are connected. To the other surface (also referred to as a rear surface) of the base portion 134, the ground plate 14, the shield case 15, and the substrate 16 are connected and fixed, in the order of distance from the base portion 134 from closest to farthest, with the screws 17.

Hereinafter, with the base portion 134 of the case 13 being used as a boundary, the space on the side where the shell 12 is located is referred to as the outside of a device and the space on the side where the ground plate 14 is located is referred to as the inside of the device. By using this definition, a direction from the outside to the inside of the device is defined as a direction to the inside or an inward direction. Likewise, a direction from the inside to the outside of the device is defined as a direction to the outside or an outward direction. Incidentally, the direction to the outside is sometimes expressed as a connector connection direction, and the direction to the inside is sometimes expressed as a connector withdrawal direction.

The case 13 is formed of an insulating material. For example, the case 13 may be made of resin. In the base portion 134 of the case 13, a hole 131 through which the signal terminal 11 can be inserted into the device from the outside of the device is provided. In an example of FIG. 1, since there are four signal terminals 11 in total, the number of provided holes 131 is also four. Incidentally, an arbitrary number of signal terminals 11 may be provided. In the base portion 134 of the case 13, a slit 133 through which a leg portion (the details thereof will be described later) of the shell 12 can be inserted into the device from the outside of the device is provided. As will be described in detail later, since four leg portions are provided in the shell 12, the number of provided slits 133 is also four. Incidentally, an arbitrary number of leg portions of the shell 12 may be provided.

The ground plate 14 is a metal quadrangular plate and has, in the center thereof, an opening 141 through which the signal terminals 11 are to be inserted. The ground plate 14 is connected to the surface (the rear surface) of the base portion 134 of the case 13 in the direction to the inside (the details thereof will be described later). At four corners of the ground plate 14, threaded holes 142 through which the screws 17 are to be inserted are provided.

The shield case 15 has, in the center thereof, an opening 151 through which the signal terminals 11 are to be inserted. At four corners of the shield case 15, threaded holes 152 through which the screws 17 are to be inserted are provided. Each side of the shield case 15 is bent in the direction to the inside and has a quadrangular shape. In the shield case 15, an unillustrated camera module or the like can be incorporated. The camera module is mounted on the substrate 16 and is covered with the shield case 15, but, here, an illustration, for example, of the camera module is omitted and only part of the structure is illustrated.

The substrate 16 has, in the center thereof, holes 161 through which the signal terminals 11 are to be inserted and elongated holes 163 through which the tips of the leg portions of the shell 12 are to be inserted. Moreover, at four corners of the substrate 16, threaded holes 162 through which the screws 17 are to be inserted are provided.

The ground plate 14, the shield case 15, and the substrate 16 are stacked and fixed to the rear surface of the case 13 with the screws 17. As described above, by fixing the ground plate 14, the shield case 15, and the substrate 16 with the screws 17, it is possible to enhance the shielding effect. Incidentally, the shield case 15 is not an indispensable component and may be omitted as appropriate. If the shield case 15 is omitted, the shielding characteristics can be enhanced only by bringing the ground plate 14 and the substrate 16 into direct contact with each other. Incidentally, fixation may be achieved not only by the screws 17, but also by a spring or welding.

Figure 2:
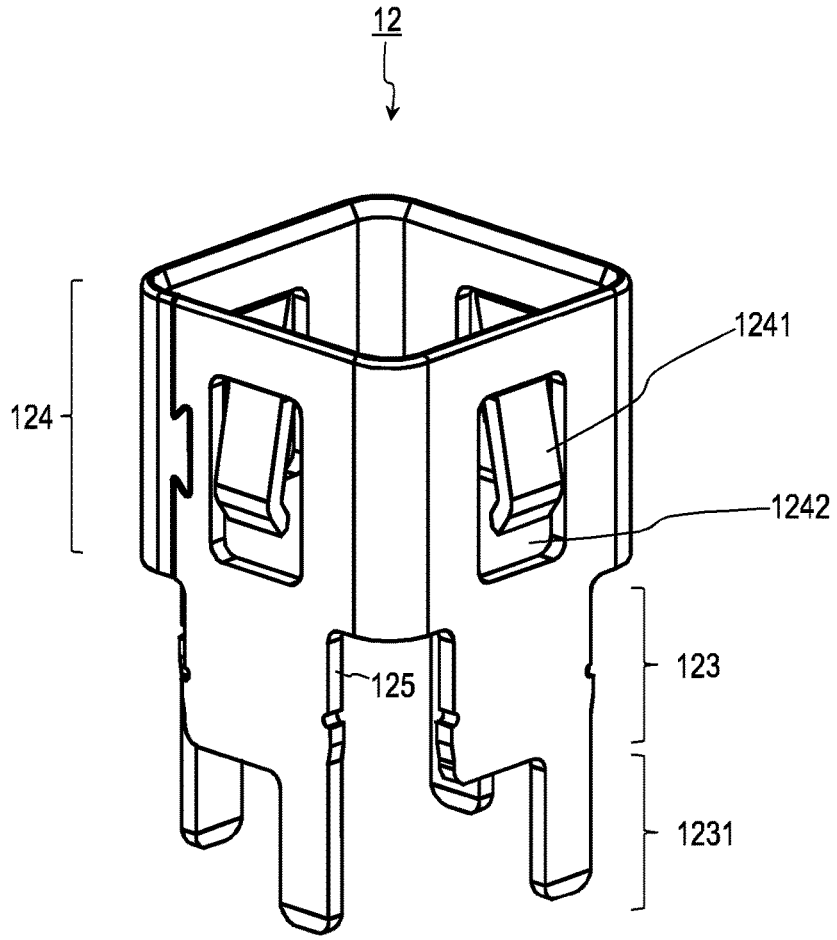
FIG. 2 is a perspective view of a shell of the first embodiment.

Next, with reference to FIG. 2, the structure of the shell 12 will be described. FIG. 2 is a perspective view of the shell 12. As depicted in FIG. 2, the shell 12 includes a body portion 124 for connection with a shell of the other connector, leg portions 123 extending from the body portion 124 in the direction to the inside (the connector withdrawal direction), and protrusions 1231, each being part of the corresponding leg portion 123 further extending in the direction to the inside (the connector withdrawal direction). The body portion 124 is shaped like a substantially rectangular cylinder, and, in each of the four side faces thereof, a spring 1241 and a connection hole 1242 are provided for fitting with the other connector. Between the adjacent leg portions 123, a notch 125 formed by making a cut in the direction to the outside (the connector connection direction) is provided.

Figure 3:
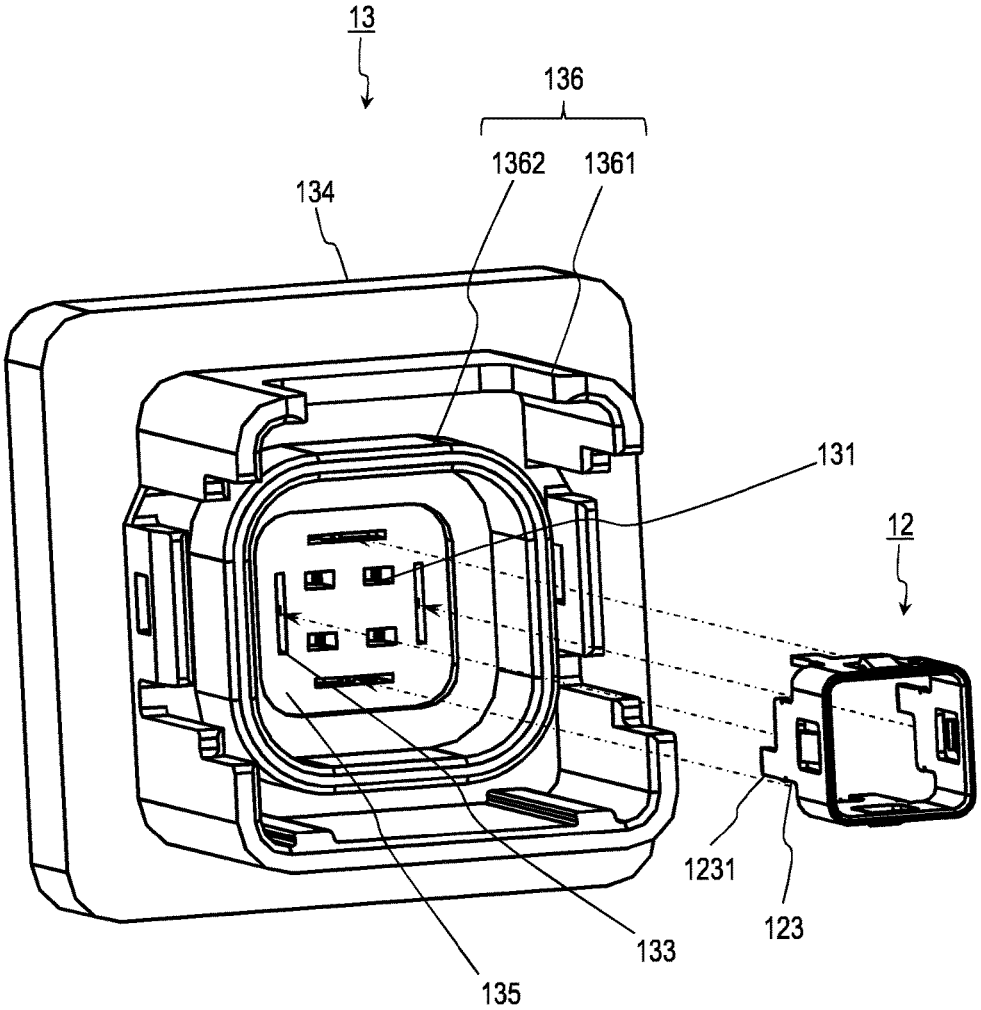
FIG. 3 is a perspective view explaining the assembly of the shell and a case of the first embodiment.

Next, with reference to FIG. 3, connection between the shell 12 and the case 13 will be described. FIG. 3 is a perspective view explaining the assembly of the shell 12 and the case 13. As depicted in FIG. 3, the fit portion 136 is provided on the surface (the front surface) of the base portion 134 in the direction to the outside and is formed of two frames 1361 and 1362 disposed such that one is nested inside the other. Inside the frame 1361, the frame 1362 which is a size smaller than the frame 1361 is disposed. Inside the frame 1362, a depression 135 obtained by slightly depressing the front surface of the base portion 134 is formed, and, in the depression 135, the above-described holes 131 and slits 133 are located. The leg portions 123 of the shell 12 and the protrusions 1231 extending from the leg portions 123 are inserted into the slits 133. As a result, the shell 12 is fixed to the case 13. Incidentally, the protrusions 1231 protrude into the device from the rear surface of the base portion 134 via the slits 133.

Figure 4:
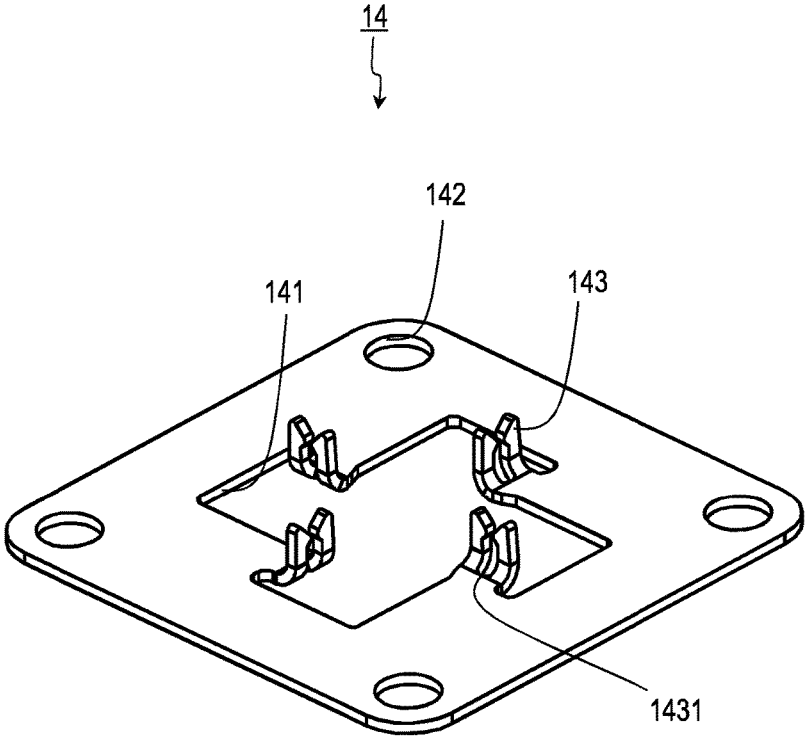
FIG. 4 is a perspective view of a ground plate of the first embodiment.

Next, with reference to FIG. 4, the structure of the ground plate 14 will be described. As depicted in FIG. 4, the ground plate 14 has a claw 143 formed by making a cut at the edge of the opening 141 in the shape of a strip and raising the strip-shaped portion in a direction toward the outside of the device (the direction to the outside, the connector connection direction). In this example, one claw 143 is provided in each side of the opening 141, and a total of four claws 143 are provided. In each claw 143, a gap 1431 is formed such that the tip of the claw 143 bifurcates into two portions. Part of each gap 1431 is narrowed, and this narrowed part makes it possible to hold, for example, a plate with a predetermined thickness satisfactorily by catching the plate in this gap 1431. The two claws 143 facing each other with the opening 141 placed therebetween are formed in the same orientation such that these two claws 143 can hold plates arranged in the same direction in their respective gaps 1431. On the other hand, the adjacent two claws 143 are formed in orientations which are 90 degrees different from each other such that these two claws 143 can hold plates arranged in directions which are 90 degrees different from each other in their respective gaps 1431.

Figure 5:
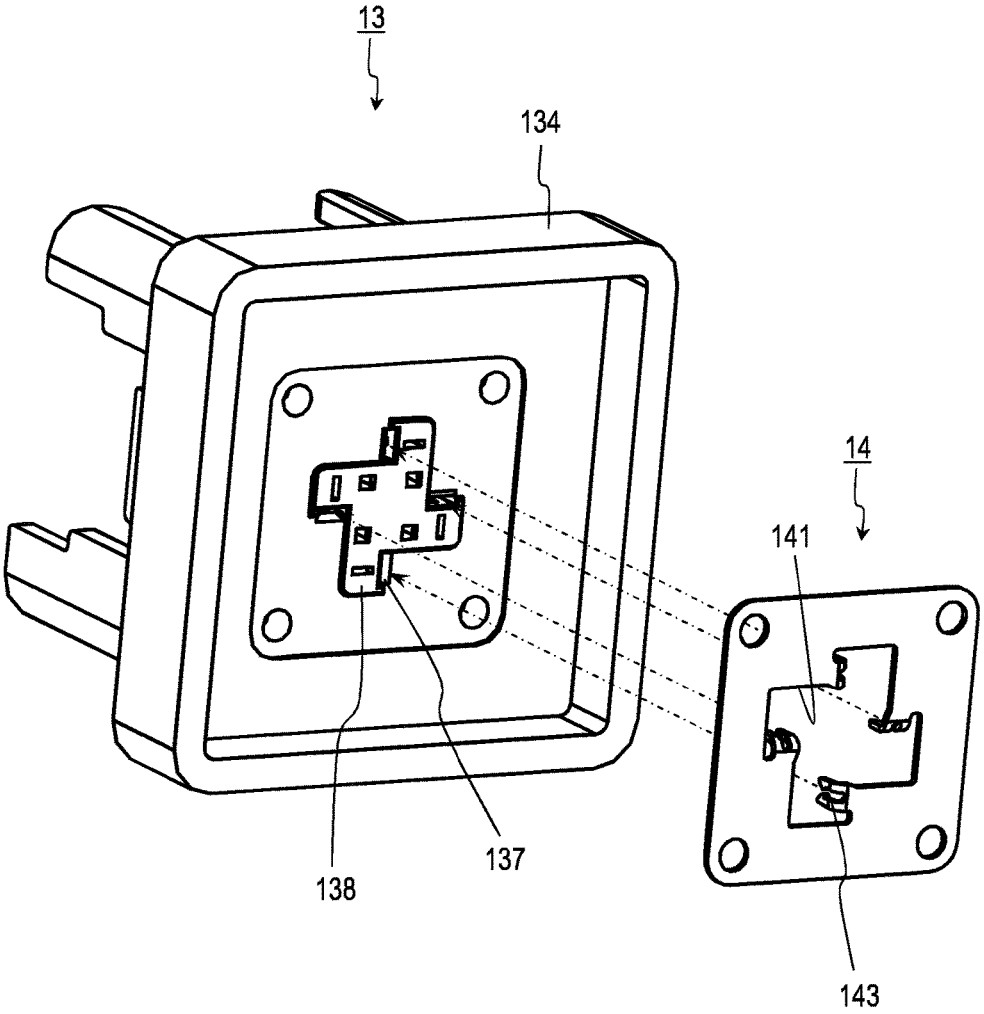
FIG. 5 is a perspective view explaining the assembly of the ground plate and the case of the first embodiment.

Next, with reference to FIG. 5, connection between the ground plate 14 and the case 13 will be described. FIG. 5 is a perspective view explaining the assembly of the ground plate 14 and the case 13. As depicted in FIG. 5, in the center of the rear surface (the surface in the direction to the inside) of the base portion 134 of the case 13, grooves 137 into which the claws 143 can be inserted are provided. Moreover, in the center of the rear surface of the base portion 134, a convex portion 138 that guides the position of the ground plate 14 by fitting into the opening 141 is provided.

The longitudinal directions of the grooves 137 and the above-described slits 133 are 90 degrees different from each other, and the grooves 137 and the slits 133 are located such that the grooves 137 and the slits 133 intersect in a cross shape. Only in an area of this intersection, the grooves 137 and the slits 133 communicate with each other and pass through the base portion 134.

Figure 6:
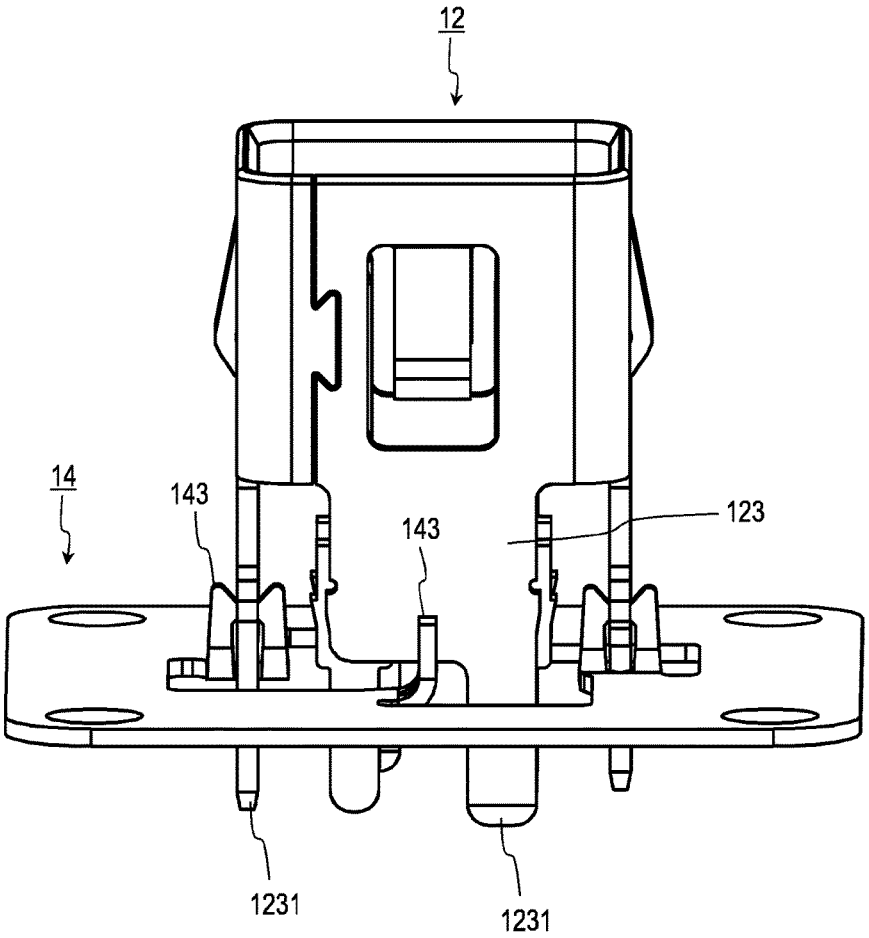
FIG. 6 is a perspective view explaining connection of the shell and the ground plate of the first embodiment.

Next, with reference to FIG. 6, connection between the shell 12 and the ground plate 14 will be described. FIG. 6 is a perspective view explaining connection between the shell 12 and the ground plate 14. In FIG. 6, only the shell 12 and the ground plate 14 are depicted and other component elements are not depicted. As depicted in FIG. 6, the narrowed portion of the gap 1431 of each claw 143 holds an area near the center of a lower end (the end closer to the inside of the device) of each leg portion 123 of the shell 12 by catching the lower end in the gap 1431, thereby supporting the shell 12 and the ground plate 14 satisfactorily and, in addition thereto, providing good continuity between the shell 12 and the ground plate 14. Incidentally, as the method for connecting the shell 12 and the ground plate 14, other variations are possible. In the present embodiment, the gap 1431 is provided in each claw 143, but the embodiment is not limited thereto. A gap (slit) may be provided in an area near the center of the lower end of each leg portion 123 and the strip-shaped claw 143 may be inserted into this gap (slit).

The protrusions 1231 protrude in the direction to the inside (the connector withdrawal direction) through the opening 141, pass through the above-described elongated holes 163, and protrude to the side of the substrate 16 where the rear surface thereof is located.

In the connector 1 of the present embodiment, since the shell 12 and the ground plate 14 are connected in the above-described manner, it is possible to produce both the shell 12 and the ground plate 14 by inexpensive press working. Moreover, since the shell 12 and the ground plate 14 are provided separately, it is possible to ensure that the user can handle the shell 12 and the ground plate 14 easily (can assemble the shell 12 and the ground plate 14 easily). Furthermore, depending on the necessity for the ground plate, it is possible to support flexibly both a variation which uses the ground plate and a variation which does not use the ground plate.

Figure 7:
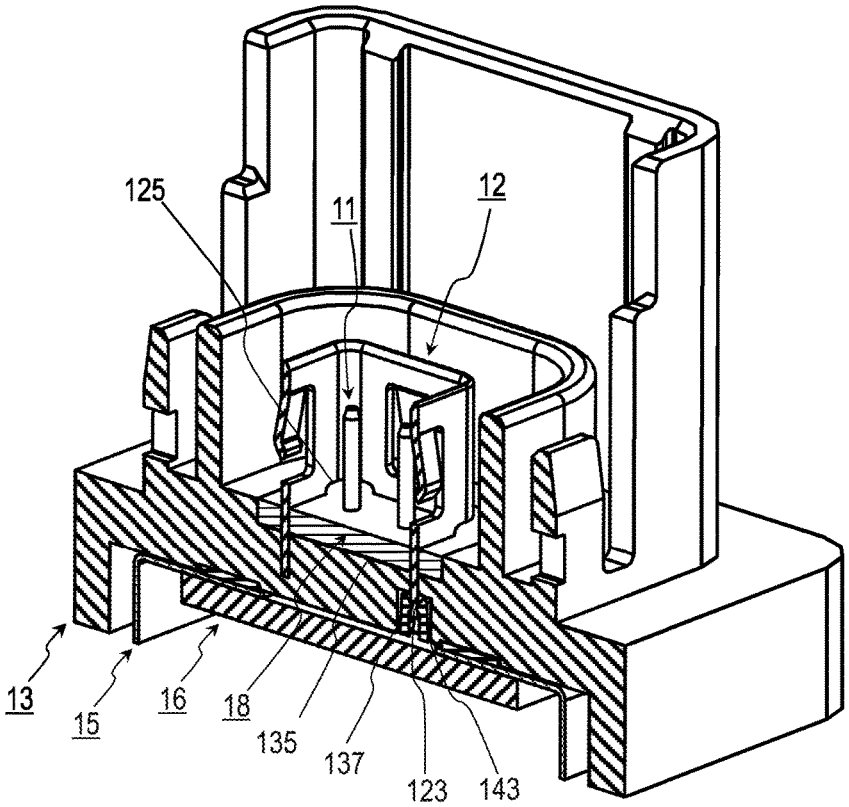
FIG. 7 is a sectional perspective view explaining filling of a depression of the case of the first embodiment with resin.

Next, with reference to FIG. 7, filling with resin (potting) to secure waterproof performance will be described. FIG. 7 is a sectional perspective view explaining filling of the depression 135 of the case 13 with resin. As depicted in FIG. 7, resin 18 is poured into the depression 135. At this time, since each notch 125 of the shell 12 is formed by cutting to a position equal to the height of the edge of the depression 135 or a position higher than the height of the edge of the depression 135, the resin 18 spreads into every corner of the depression 135 by flowing into the shell 12 or flowing out of the shell 12 through the notches 125. As a result, a slight space between each signal terminal 11 and each hole 131 or a slight space between each leg portion 123 of the shell 12 and each slit 133 is sealed satisfactorily with the resin 18.

As described above, the grooves 137 and the slits 133 are located such that the grooves 137 and the slits 133 intersect in a cross shape, and, only in an area of intersection, the grooves 137 and the slits 133 communicate with each other. Therefore, in a state in which the claws 143 placed through the grooves 137 and the leg portions 123 placed through the slits 133 are coupled to each other, since most of openings produced as a result of the grooves 137 and the slits 133 intersecting are closed, there is only a very slight space left. Since the connector 1 of the present embodiment has such a configuration, the resin rarely leaks into the device when filling with resin is conducted. This feature is preserved even when the slits 133 and the grooves 137 are made longer. Therefore, the configuration in which the grooves 137 and the slits 133 are made to cross each other in a cross shape has the advantage that a reduction in yields caused by filling with resin is effectively prevented with ease of assembly being maintained.

For example, in Patent Literature 1 described earlier, as depicted in FIG. 5 thereof, a contact piece 84 of a ground shell 10 is in contact with a shield case 80 via a lower case 7. Since the contact piece 84 is formed in a bulging shape to allow the contact piece 84 to be elastically deformed, a hole has to be provided in the lower case to pass the contact piece 84 therethrough with consideration given even to the bulging portion of the contact piece 84, which makes the hole tend to increase in size. As a result, when filling with resin (potting) is conducted, the resin may flow through the above-described hole toward the side where an electronic device is located. Moreover, Patent Literature 1 includes a description to the effect that, after a potting agent 90 is cured, the contact piece 84 of the ground shell 10 is inserted into the lower case 7. In this case, there is a possibility that the contact piece 84 is deformed as a result of the shield shell 9 and the contact piece 84 making contact with each other and a space is left between the contact piece 84 and the resin used for filling, which decreases waterproofness.

Furthermore, as depicted in FIG. 7, since the claws 143 are raised upward (in a direction to the outside of the device, the outward direction, the connector connection direction) and are housed in the grooves 137 of the case 13 and the shield case 15 is sandwiched between the ground plate 14 and the substrate 16, an air gap is generated between the claws 143 and the substrate 16, making it possible to avoid contact between the claws 143 and the substrate 16. This configuration eliminates the need to provide extra space between the substrate 16 and the ground plate 14 and thereby contributes to a reduction in the size of the connector.

Second Embodiment

Figure 8:
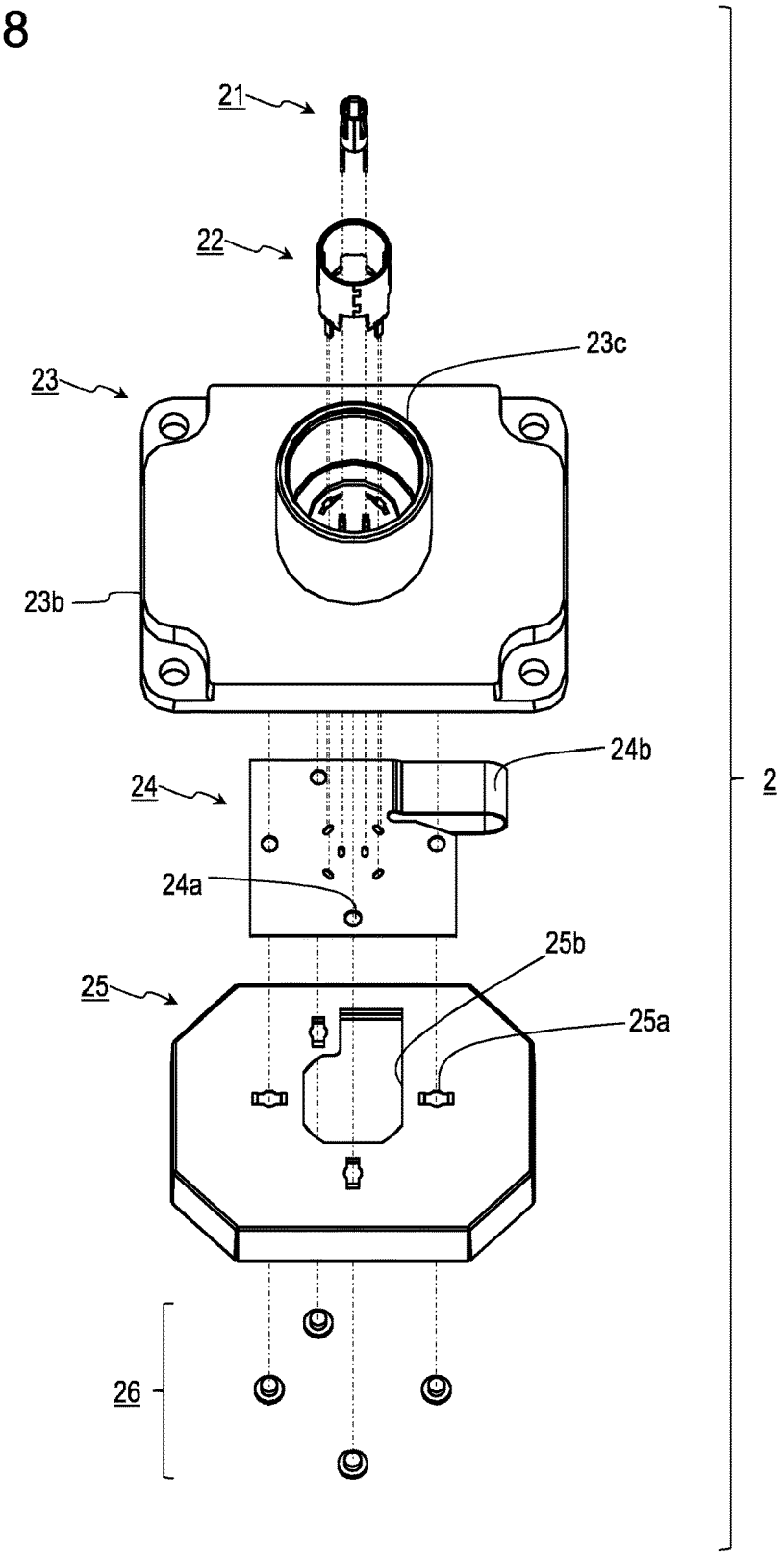
FIG. 8 is an exploded perspective view of a connector of a second embodiment.

Hereinafter, with reference to FIG. 8, a connector of a second embodiment will be described. FIG. 8 is an exploded perspective view of a connector 2 of the present embodiment. As depicted in FIG. 8, the connector 2 of the present embodiment has a configuration including a signal terminal 21 formed of a conductor material, a shell 22 which is formed of a conductor material and is substantially cylindrical, a case 23 formed of an insulating material (for example, made of resin), a flexible printed circuit (FPC) 24, a shield case 25 formed of a conductor material, and screws 26.

The case 23 includes a plate-like base portion **23*b* and a cylindrical fit portion 23*c* having the function of providing a fit with the other connector by protruding from the base portion 23*b***.

To the front surface (a surface on which the fit portion **23*c* is formed) of the base portion 23*b*, the signal terminal 21 and the shell 22 are connected. To the rear surface of the base portion 23*b*, the FPC 24 and the shield case 25 are connected and fixed, in the order of distance from the base portion 23*b* from closest to farthest, with the screws 26. By fixing the FPC 24 and the shield case 25 with the screws 26, it is possible to enhance the shielding effect (the details thereof will be described later). Incidentally, fixation may be achieved not only by the screws 26**, but also by a spring or welding.

Hereinafter, with the base portion **23*b* of the case 23 being used as a boundary, the space on the side where the shell 22 is located is referred to as the outside of a device and the space on the side where the FPC 24** is located is referred to as the inside of the device. By using this definition, a direction from the outside to the inside of the device is defined as a direction to the inside or an inward direction. Likewise, a direction from the inside to the outside of the device is defined as a direction to the outside or an outward direction. Incidentally, the direction to the outside is sometimes expressed as a connector connection direction, and the direction to the inside is sometimes expressed as a connector withdrawal direction.

The FPC 24 is a thin circuit board which is substantially quadrangular and flexible. The FPC 24 includes a ribbon-like thin slice **24*b* formed as a result of one vertex of the FPC 24 being extended in the shape of a band. The front surface of the FPC 24 is formed as an insulating layer called a cover film or an insulating layer called a resist, and, under the insulating layer, a copper foil layer for shielding, a copper foil layer for signal transmission, and so forth are formed. The FPC 24 is connected to the surface (the rear surface) of the base portion 23***b* of the case 23 in the direction to the inside (the details thereof will be described later). In the FPC 24, threaded holes 24*a* through which the screws 26 are to be inserted are provided.

The shield case 25 has, in the center thereof, an opening 25*b* through which the signal terminal 21 and the shell 22 are to be inserted. The opening 25*b* is provided to avoid contact with the tip of a leg portion of the signal terminal 21. Near the opening 25*b*, threaded holes 25*a* through which the screws 26 are to be inserted are provided. Each of the sides of the shield case 25 is bent in the direction to the inside (toward the rear surface). In the shield case 25, an unillustrated camera module or the like can be incorporated. The camera module is covered with the shield case 25, but, here, an illustration, for example, of the camera module is omitted and only part of the structure is illustrated.

Figure 9:
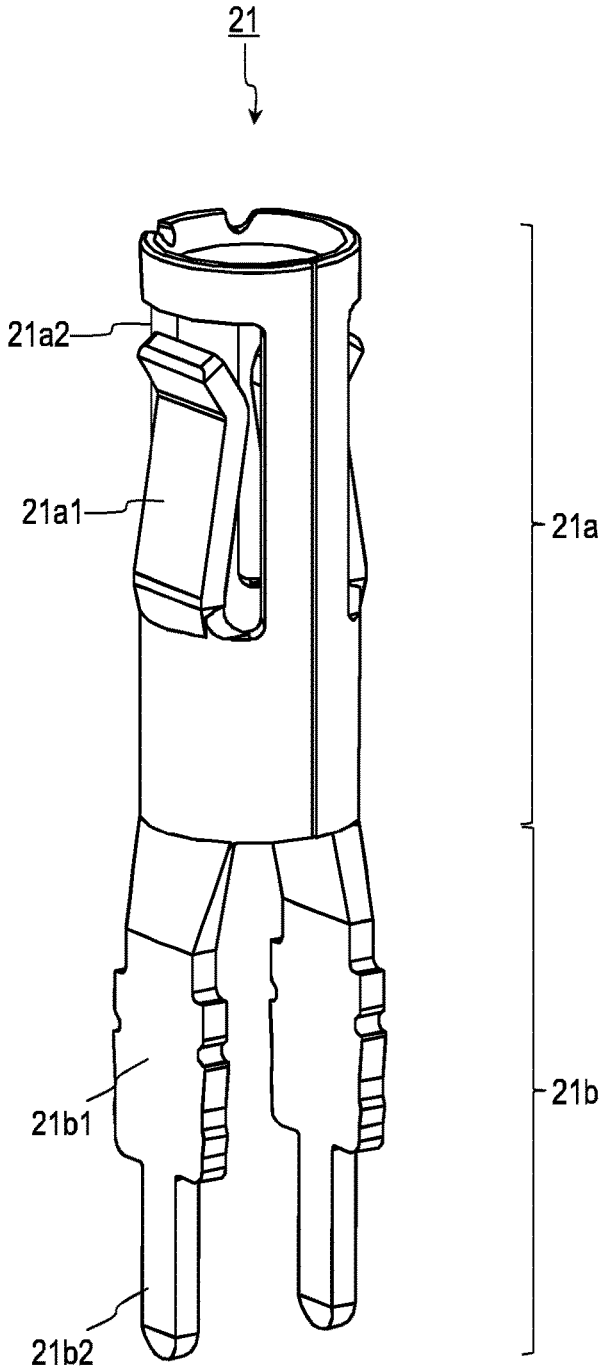
FIG. 9 is a perspective view of a signal terminal of the second embodiment.

Next, with reference to FIG. 9, the structure of the signal terminal 21 will be described. FIG. 9 is a perspective view of the signal terminal 21. As depicted in FIG. 9, the signal terminal 21 includes a body portion 21*a* for connection with a signal terminal of the other connector and a leg portion 21*b* extending from the body portion 21*a* in the direction to the inside (the connector withdrawal direction). The body portion 21*a* is substantially cylindrical, and, in the side face thereof, a spring 21*a*1 and a connection hole 21*a*2 are provided for fitting with the other connector. In this embodiment, the body portion 21*a* includes two sets of the spring 21*a*1 and the connection hole 21*a*2. The leg portion 21*b* includes a strip-shaped wide portion 21*b*1 extending from the body portion 21*a* in the direction to the inside (the connector withdrawal direction) and a narrowed portion 21*b*2 which has the shape of a strip narrower than the wide portion 21*b*1 and further extends from the wide portion 21*b*1 in the direction to the inside (the connector withdrawal direction). In this embodiment, the leg portion 21*b* includes two sets of the wide portion 21*b*1 and the narrowed portion 21*b*2.

Figure 10:
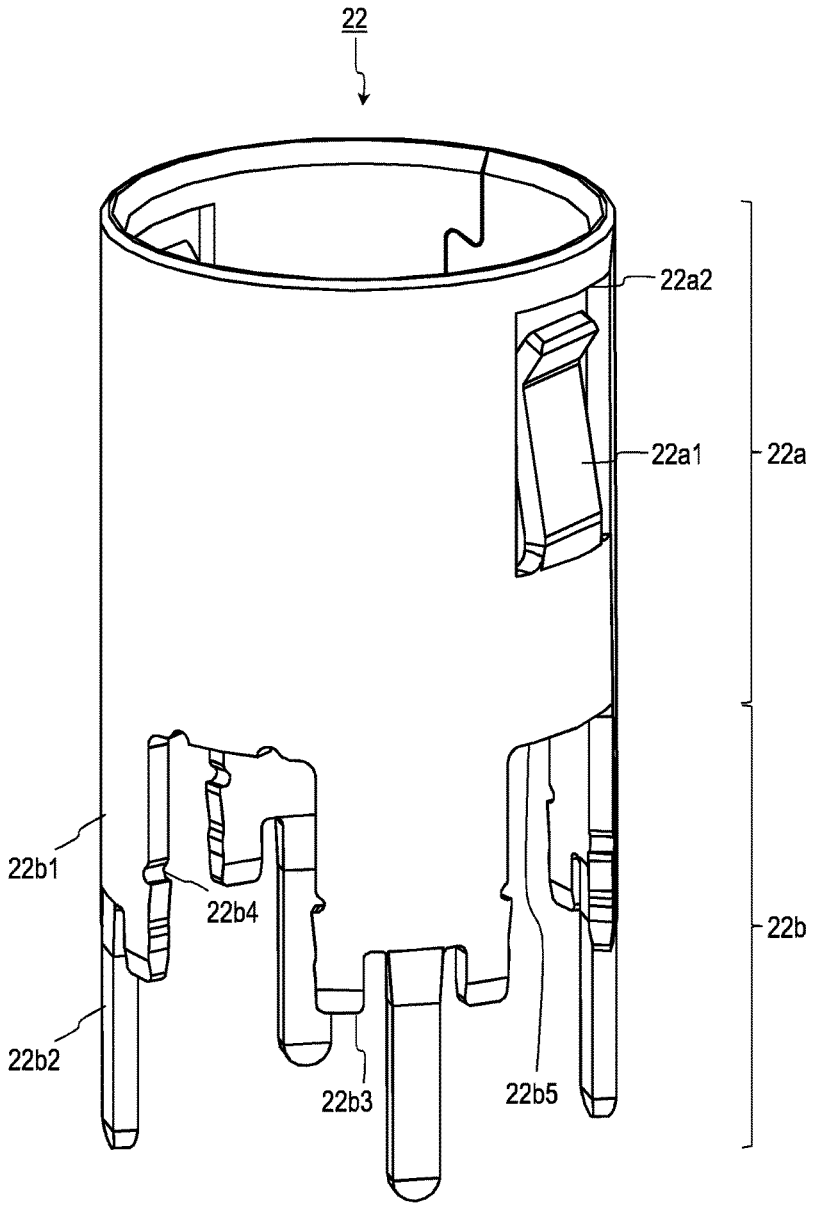
FIG. 10 is a perspective view of a shell of the second embodiment.

Next, with reference to FIG. 10, the structure of the shell 22 will be described. FIG. 10 is a perspective view of the shell 22. As depicted in FIG. 10, the shell 22 includes a body portion 22*a* for connection with a shell of the other connector and a leg portion 22*b* extending from the body portion 22*a* in the direction to the inside (the connector withdrawal direction). The body portion 22*a* is substantially cylindrical and, in the side face thereof, a spring 22*a*1 and a connection hole 22*a*2 are provided for fitting with the other connector. In this embodiment, the body portion 22*a* includes two sets of the spring 22*a*1 and the connection hole 22*a*2. The leg portion 22*b* includes a strip-shaped wide portion 22*b*1 extending from the body portion 22*a* in the direction to the inside (the connector withdrawal direction) and a narrowed portion 22*b*2 which has the shape of a strip narrower than the wide portion 22*b*1 and further extends from the wide portion 22*b*1 in the direction to the inside (the connector withdrawal direction). In this embodiment, the leg portion 22*b* includes four sets of the wide portion 22*b*1 and the narrowed portion 22*b*2. Between the adjacent wide portions 22*b*1, a notch 22*b*5 provided by making a cut in the direction to the outside (the connector connection direction) is formed. From the end of the wide portion 22*b*1 in the direction to the inside (the connector withdrawal direction), a convex portion 22*b*3 extends in the same direction as the narrowed portion 22*b*2. The narrowed portion 22*b*2 extends from an area of the wide portion 22*b*1 near the center of the width of the wide portion 22*b*1, and one convex portion 22*b*3 is provided on each side of the narrowed portion 22*b*2 such that the narrowed portion 22*b*2 is placed between the convex portions 22*b*3. The convex portion 22*b*3 is shorter than the narrowed portion 22*b*2. At about the middle of the end face of the wide portion 22*b*1, a groove 22*b*4 is provided.

Figure 11:
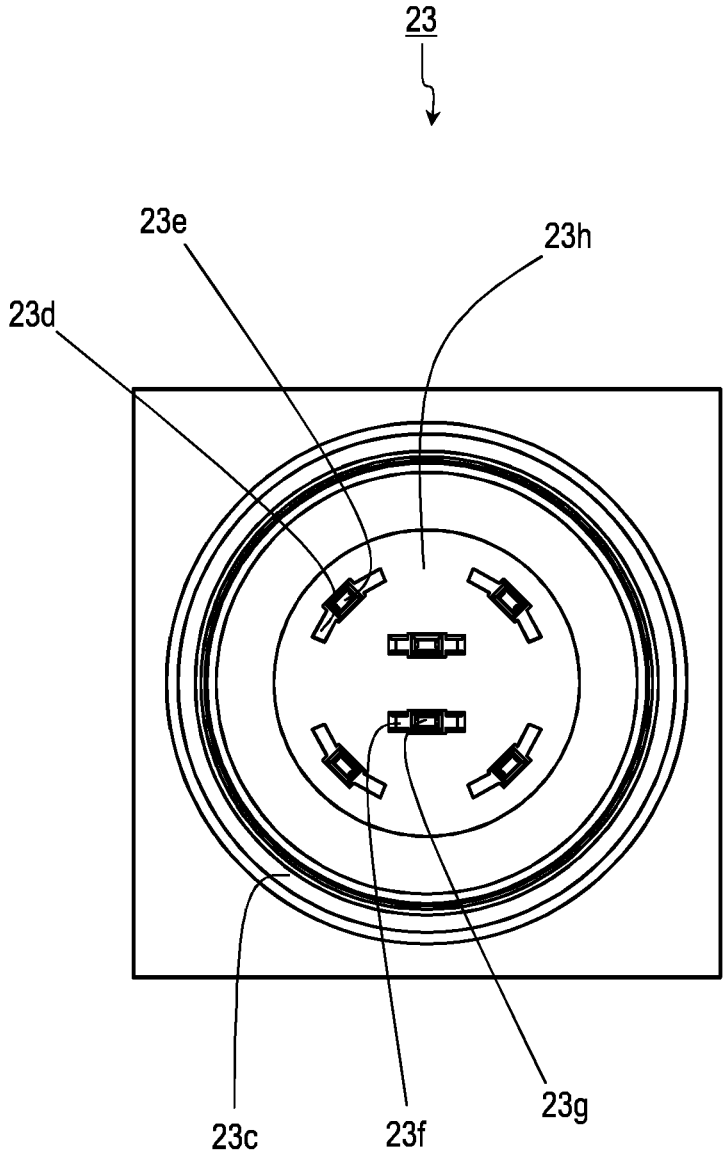
FIG. 11 is a partially enlarged view of a case of the second embodiment.

Next, with reference to FIG. 11, the structure of the inside of the fit portion 23*c* of the case 23 will be described. FIG. 11 is a partially enlarged view of the case 23. As depicted in FIG. 11, in the fit portion 23*c*, the following elements are formed: an arc-shaped circling groove 23*d* which does not pass through the case 23 from the front surface to the rear surface thereof, a through hole 23*e* which is provided in the circling groove 23*d* and passes through the case 23 from the front surface to the rear surface thereof, a central groove 23*f* which is provided in a central region in the fit portion 23*c* and does not pass through the case 23 from the front surface to the rear surface thereof, a through hole 23*g* which is provided in the central groove 23*f* and passes through the case 23 from the front surface to the rear surface thereof, and a circular depression 23*h*. In the present embodiment, four circling grooves 23*d* are disposed on the same circumference of a circle in such a way as to surround the central region. In the depression 23*h*, the four circling grooves 23*d* and the central grooves 23*f* are provided. In the present embodiment, two central grooves 23*f* are provided.

The wide portions 21*b*1 of the signal terminal 21 are housed in the central grooves 23*f*. The narrowed portions 21*b*2 of the signal terminal 21 are inserted into the through holes 23*g*, and the tips thereof protrude from the rear surface of the case 23.

The wide portions 22*b*1 and the convex portions 22*b*3 of the shell 22 are housed in the circling grooves 23*d*. The narrowed portions 22*b*2 of the shell 22 are inserted into the through holes 23*e*, and the tips thereof protrude from the rear surface of the case 23.

Next, filling with resin (potting) to secure waterproof performance will be described. Resin is poured into the depression 23*h*. At this time, since each notch 22*b*5 of the shell 22 is formed by cutting to a position equal to the height of the edge of the depression 23*h* or a position higher than the height of the edge of the depression 23*h*, the resin spreads into every corner of the depression 23*h* and into the circling grooves 23*d* and the central grooves 23*f* by flowing into the shell 22 or flowing out of the shell 22 through the notches 22*b*5. As a result, a slight space between each narrowed portion 21*b*2 of the signal terminal 21 and each through hole 23*g* or a slight space between each narrowed portion 22*b*2 of the shell 22 and each through hole 23*e* is sealed satisfactorily with the resin.

Figure 12:
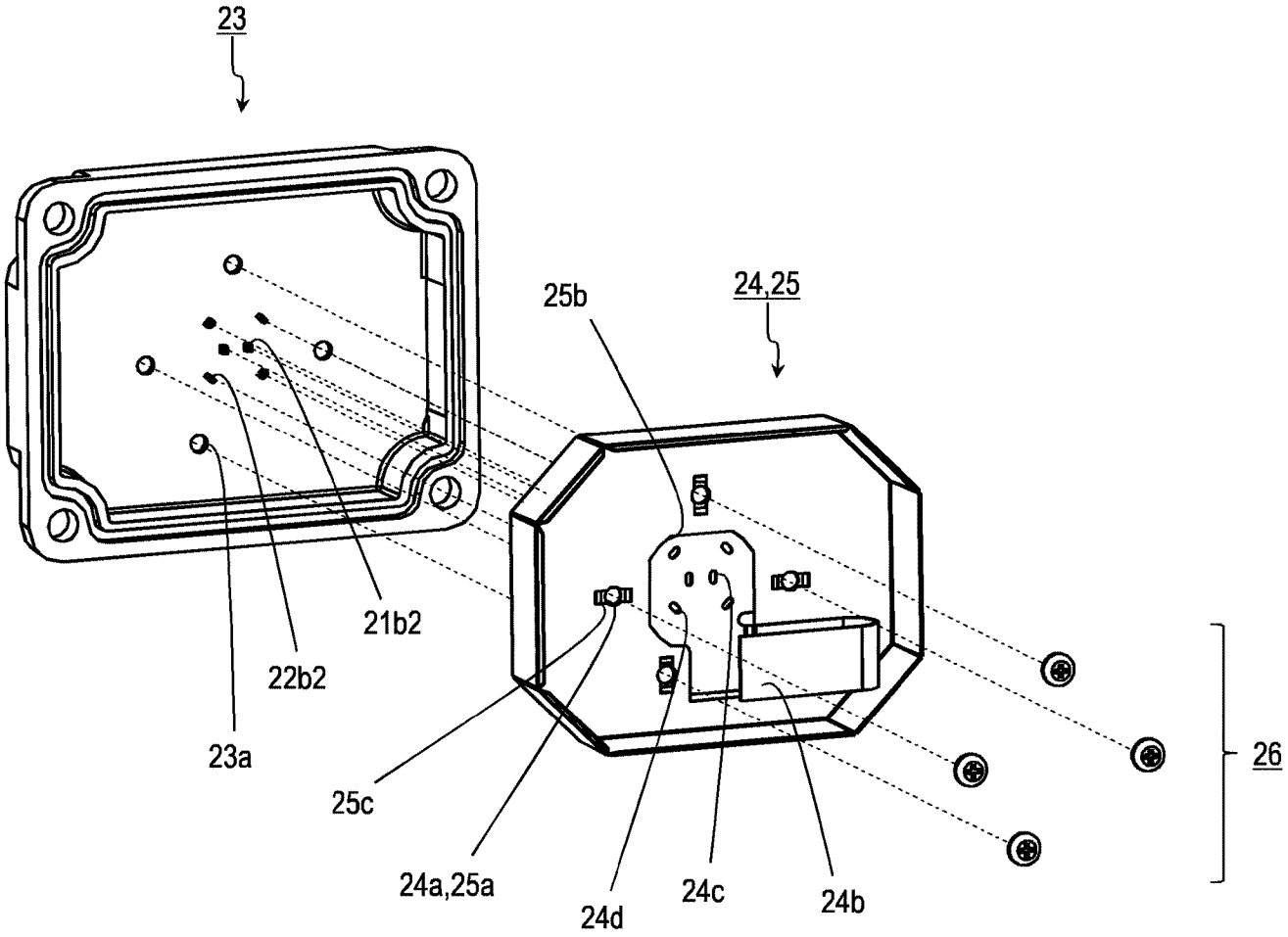
FIG. 12 is a perspective view explaining the assembly of the case, an FPC, and a shield case of the second embodiment.

Hereinafter, with reference to FIG. 12, the assembly of the case 23, the FPC 24, and the shield case 25 will be described. FIG. 12 is a perspective view explaining the assembly of the case 23, the FPC 24, and the shield case 25. As depicted in FIG. 12, the FPC 24 is located on the front surface side of the shield case 25 (the side in the connector connection direction), but the ribbon-like thin slice 24*b* of the FPC 24 is inserted into the opening 25*b* and located on the rear surface side of the shield case 25 (the side in the connector withdrawal direction). Incidentally, around each threaded hole 25*a* of the shield case 25, claws 25*c* rising toward the front surface side of the shield case 25 (the side in the connector connection direction) are formed. The claws 25*c* are formed to ensure contact with continuity portions 24*e* of the FPC 24, which will be described later.

The tips of the narrowed portions 21*b*2 of the signal terminal 21 and the tips of the narrowed portions 22*b*2 of the shell 22 protrude from the rear surface of the case 23. The tips of the narrowed portions 21*b*2 pass through the FPC 24 by being inserted into terminal insertion holes 24*c* of the FPC 24 and come out of the rear surface thereof, and the tips are electrically connected by being soldered thereto. Likewise, the tips of the narrowed portions 22*b*2 of the shell 22 pass through the FPC 24 by being inserted into shell insertion holes 24*d* of the FPC 24 and come out of the rear surface thereof, and the tips are electrically connected by being soldered thereto. The screws 26 fix the FPC 24 and the shield case 25 to the case 23 by being inserted through the threaded holes 24*a*, the threaded holes 25*a*, and the threaded holes 23*a*.

Figure 13:
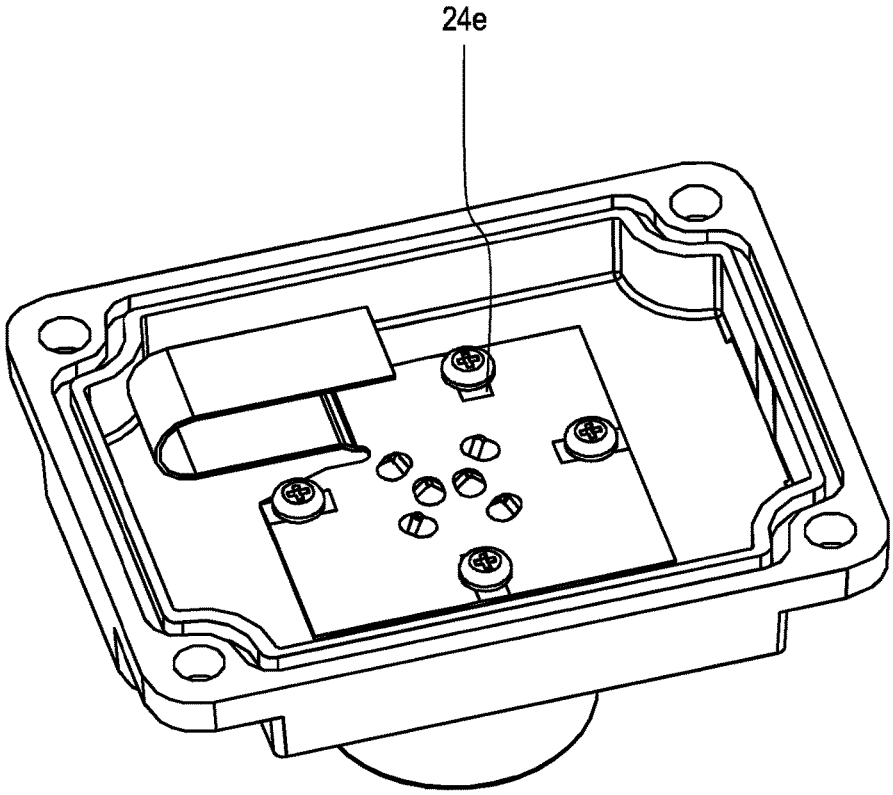
FIG. 13 is a perspective view depicting a rear surface of the connector of the second embodiment from which the shield case is omitted.

Hereinafter, with reference to FIG. 13, continuity between the FPC 24 and the shield case 25 will be described. FIG. 13 is a perspective view depicting the rear surface of the connector 2 of the present embodiment from which the shield case 25 is omitted. As depicted in FIG. 13, around each threaded hole 24*a* of the FPC 24, the continuity portion 24*e* is provided. The continuity portion 24*e* can be formed by, for example, exposing a shield layer by stripping off the cover film layer (or the resist layer) of the FPC 24. If the continuity portion 24*e* is formed by stripping off the cover film layer (or the resist layer), the continuity portion 24*e* is formed in a depression lower than the entire rear surface of the FPC 24 (in the connector connection direction). By forming the claws 25*c* so as to rise in the direction of the continuity portions 24*e* with consideration given to this depression, it is possible to bring the continuity portions 24*e* and the claws 25*c* into contact with each other reliably and electrically connect the FPC 24 and the shield case 25 reliably.

As described earlier, the narrowed portions 22*b*2 of the shell 22 are electrically connected to the shell insertion holes 24*d* by being inserted into the shell insertion holes 24*d* and soldered thereto. The shell insertion holes 24*d* and the continuity portions 24*e* are electrically connected via the shield layer. This ensures an electrical path between the shell 22 and the shield case 25 and makes it possible to achieve a stable shielding effect.

Meanwhile, the narrowed portions 21*b*2 of the signal terminal 21 are electrically connected to the terminal insertion holes 24*c* by being inserted into the terminal insertion holes 24*c* and soldered thereto. However, the terminal insertion holes 24*c* are insulated from the continuity portions 24*e*. For example, the terminal insertion holes 24*c* are connected to a conductor layer (for example, a conductor layer for a signal circuit) which is different from the shield layer, but insulated from the shield layer. As a result, an electrical path is not formed between the signal terminal 21 and the shield case 25.

That is, the FPC 24 has an internal structure in which the terminal insertion holes 24*c* and the continuity portions 24*e* are insulated from each other and continuity is provided between the shell insertion holes 24*d* and the continuity portions 24*e*.

The above-described FPC 24 may be replaced with another arbitrary interposition member. As described above, the interposition member has to be provided with an internal structure in which the terminal insertion holes 24*c* and the continuity portions 24*e* are insulated from each other and continuity is provided between the shell insertion holes 24*d* and the continuity portions 24*e*. Therefore, for example, as the interposition member, a printed circuit board in which a circuit structure can be configured may be adopted.

Since the connector 2 of the present embodiment is provided with the above-described FPC 24, it is possible to ensure both signal transmission and shielding performance with one part. This makes it possible to achieve good shielding characteristics with a simple structure.

The foregoing description of the embodiments of the invention has been presented for the purpose of illustration and description. It is not intended to be exhaustive and to limit the invention to the precise form disclosed. Modifications or variations are possible in light of the above teaching. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A connector comprising:

a shell that has a cylindrical shape and includes a body portion and a leg portion, the body portion being connected to a shell of another connector;

a ground plate that is a conductor plate;

a claw that has a structure in which part of the ground plate is raised in a connector connection direction so as to have a strip-shaped tip and the tip supports the leg portion of the shell; and a case made of an insulator, the case to which the shell and the ground plate are to be attached, wherein the case includes a plate base portion, a slit that is provided in one surface of the base portion, the slit into which the leg portion is to be inserted, and a groove that is provided in another surface of the base portion, the groove into which the claw is to be inserted.

2. The connector according to claim 1, wherein the slit and the groove are provided such that longitudinal directions thereof are different from each other.

3. The connector according to claim 2, wherein the slit and the groove communicate with each other only in a position in which the slit and the groove intersect and pass through the base portion from the one surface to the other surface.

4. The connector according to claim 1, wherein in the one surface of the base portion, a depression which is configured to be filled with resin is provided, the slit is located in the depression, and a notch for making the resin flow into the shell or flow out of the shell is provided in a side face of the shell.

5. A connector comprising:

a signal terminal that is provided with a leg portion;

a shell that is provided with a leg portion;

a shield case; and an interposition member that includes a terminal insertion hole to which the leg portion of the signal terminal is electrically connected by being inserted thereinto, a shell insertion hole to which the leg portion of the shell is electrically connected by being inserted thereinto, and a continuity portion which is electrically connected to the shield case, and has an internal structure in which the terminal insertion hole and the continuity portion are insulated from each other and continuity is provided between the shell insertion hole and the continuity portion, wherein a claw that rises in a direction of the continuity portion is provided in the shield case, and the continuity portion and the claw make contact with each other when the interposition member and the shield case are fixed to a case.

6. A connector comprising:

a signal terminal that is provided with a leg portion;

a shell that is provided with a leg portion;

a shield case; and an interposition member that includes a terminal insertion hole to which the leg portion of the signal terminal is electrically connected by being inserted thereinto, a shell insertion hole to which the leg portion of the shell is electrically connected by being inserted thereinto, and a continuity portion which is electrically connected to the shield case, and has an internal structure in which the terminal insertion hole and the continuity portion are insulated from each other and continuity is provided between the shell insertion hole and the continuity portion, wherein the leg portion of the signal terminal and the leg portion of the shell pass through the interposition member from one side to another side thereof, the shield case is located on the other side of the interposition member, and the shield case has an opening provided in a position where contact with the leg portion of the signal terminal is avoidable.

* * * * *